United States Patent [19]

Janotik

[11] Patent Number: 4,816,627

[45] Date of Patent: Mar. 28, 1989

[54] FLUID DAMPED ACCELERATION SENSOR

[75] Inventor: Adam M. Janotik, Grosse Ile, Mich.

[73] Assignee: Ford Motor Company, Dearborn, Mich.

[21] Appl. No.: 137,637

[22] Filed: Dec. 24, 1987

[51] Int. Cl.[4] ..... H01H 35/14

[52] U.S. Cl. ..... 200/61.45 M; 200/61.53; 200/83 N

[58] Field of Search ..... 340/52 H, 669; 180/282; 307/10 R; 200/34, 61.45 M, 61.45 R, 61.53, 83 N, 83 R, 83 W

[56] References Cited

U.S. PATENT DOCUMENTS

| | | | |
|---|---|---|---|
| 3,154,652 | 10/1964 | Gilman | 200/83 W |
| 3,889,130 | 6/1975 | Breed | 200/61.53 |
| 4,284,863 | 8/1981 | Breed | 200/61.53 |
| 4,329,549 | 5/1982 | Breed | 200/61.45 M |
| 4,533,801 | 8/1985 | Jackman | 200/61.45 R |

*Primary Examiner*—Gerald P. Tolin

*Attorney, Agent, or Firm*—Daniel M. Stock; Clifford L. Sadler

[57] ABSTRACT

An acceleration sensor for an automotive inflatable occupant restraint system employs a rolling diaphragm to divide a housing into two chambers in fluid communication through orifices across the diaphragm. The orifices damp the motion of an acceleration sensing mass with respect to the diaphragm.

24 Claims, 3 Drawing Sheets

FLUID DAMPED ACCELERATION SENSOR

BACKGROUND OF THE INVENTION

The present invention relates generally to acceleration sensors and more specifically to acceleration sensors of the type adapted for use in an automotive vehicle equipped with an inflatable passenger restraint or airbag. To operate an inflatable occupant restraint system in an automotive vehicle, it has been found most desirable to provide one or more sensors positioned in the vehicle that respond to changes in the vehicle's velocity to transmit an electrical signal to operate the inflating device. One type of such sensor found to be functionally acceptable is a sensor having an acceleration sensing mass on which a biasing force is imposed by a permanent magnet. The mass is moved in response to the occurrence of an acceleration pulse at a level above a predetermined level to a position in which it closes a switch to operate the inflatable restraint device. Magnetic force is used to hold the mass in its inactive position and movement of the mass is fluid damped to identify accelerations of sufficient magnitude and duration to make inflation desirable by controlling the peripheral clearance between the mass and the structure surrounding it as it moves in its path to close the switch. U.S. Pat. No. 4,329,549 to Breed is exemplary of such sensors. One alternative to such designs is the substitution of a spring mechanism for the magnet in biasing the acceleration sensing mass to its inactive position. Exemplary of such designs is that shown in U.S. Pat. No. 4,284,863 to Breed.

While functionally acceptable, the known sensors suffer certain disadvantages which adversely affect the cost of their manufacture. Chief among these are the necessity to closely control peripheral tolerance between the mass, which is generally formed as a Precision ball, with respect to a metallic housing or sleeve in which is formed a bore along which the ball travels. Expensive plating, honing and selective assembly operations are sometimes necessary to assemble acceptable sensors.

Another disadvantage, in part related to the requirement for closely controlling tolerances between acceleration mass and housing or sleeve, is the expense attendant the need to compensate for differential thermal expansion between parts. This has required the use of expensive and difficult to machine materials, and the provision of certain materials and some mechanisms for sealing the sensors such as potting which do not lend themselves well to automatic assembly techniques.

SUMMARY OF THE INVENTION

Responsive to the disadvantages of the acceleration sensors of the prior art, it is an object of the present invention to provide a sensor of the biased sliding mass type which provides accelerator sensing and switch closure operation equivalent to the prior art sensors of that type without their attendant manufacturing cost disadvantages.

According to a feature of the present invention, this object is accomplished through the provision of a sensor in which a magnetically biased ball is carried in a plastic housing with substantial clearance between the ball and the bore in which the ball travels and a rolling diaphragm is used to define a pair of gas filled chambers having orifices formed therebetween to effect fluid damping in the movement of the ball.

BRIEF DESCRIPTION OF THE DRAWINGS

This and other objects and features will become apparent to those skilled in the automotive occupant restraint arts upon reading the following description with reference to the accompanying drawings in which.

DESCRIPTION OF THE PREFERRED EMBODIMENT

Figure 1:
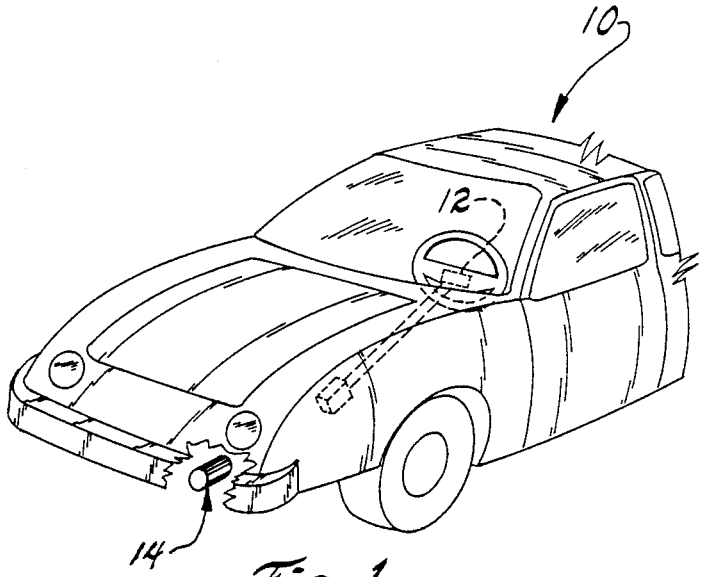
FIG. 1 is a perspective view of an automobile in which a sensor according to the present invention is installed.

Turning now to the drawings and particularly to FIG. 1 thereof, an automotive vehicle 10 having an inflatable passive restraint system consisting of an airbag indicated at 12 is illustrated as including an acceleration sensor assembly 14 positioned within the vehicle 10 and operatively connected to the airbag 12 to effect inflation of the air bag 12 upon sensing an acceleration pulse above a predetermined magnitude.

Figure 2:
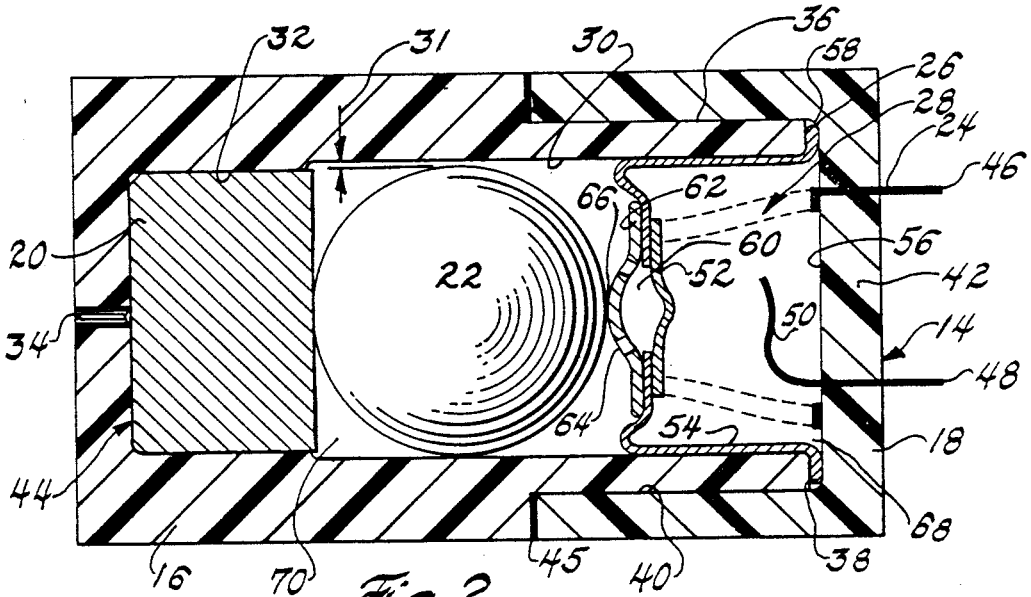
FIG. 2 is a diagrammatic cross-sectional view of a sensor according to the present invention.

The sensor 14 is carried in the vehicle 10 in a known manner and, as can be seen in FIG. 2, consists essentially of a housing 16, a cover 18, a biasing magnet 20, an acceleration sensing mass 22, a contact assembly 24 and a damping assembly 26.

It is contemplated in the present invention that the housing 16 may be formed as an injection molded plastic part having a stepped bore 28 formed internally thereto. The stepped bore 28 includes a first operating bore 30, a second magnet mounting bore 32 and may include a vent hole 34 for facilitating assembly. An outer surface portion 36 formed adjacent the open end 38 of the housing 16 has a reduced cross-section for receiving the cover 18.

The cover 18 is formed as a cup-like member (preferably of the same material as the housing 16) having an inner peripheral surface 40 shaped for slip fit engagement with the outer surface 36 of the housing 16. An end wall 42 of the housing 18 is pierced in known fashion by the contact assembly 24.

The biasing magnet 20 is a permanent magnet chosen to have sufficient strength to bias the sensing mass 22 to the inactive position shown in FIG. 2 against a load tending to shift the mass 22 rightwardly as viewed in FIG. 1. Its attractive force is equal to an acceptable level as emperically determined to permit the sensor 14 to discriminate between an acceleration pulse representing a significant collision of the vehicle, upon which the airbag 12 should be deployed, or another less significant acceleration pulse. Biasing forces resisting accelerations of two to five "g's" have been found to be acceptable. The biasing magnet 20 is preferably formed to be slidingly received in the bore 32 and may be retained in the housing 16 by application of a layer of adhesive as indicated at 44.

The acceleration sensing mass 22 is formed as a spherical magnetically permeable structure. Non-precision steel balls fabricated from 400 series stainless steel or SAE-52-100 steel may be utilized. Substantial clearances are established between the outer diameter of the ball and the diameter of the bore 30 of the housing 16.

Figure 3:
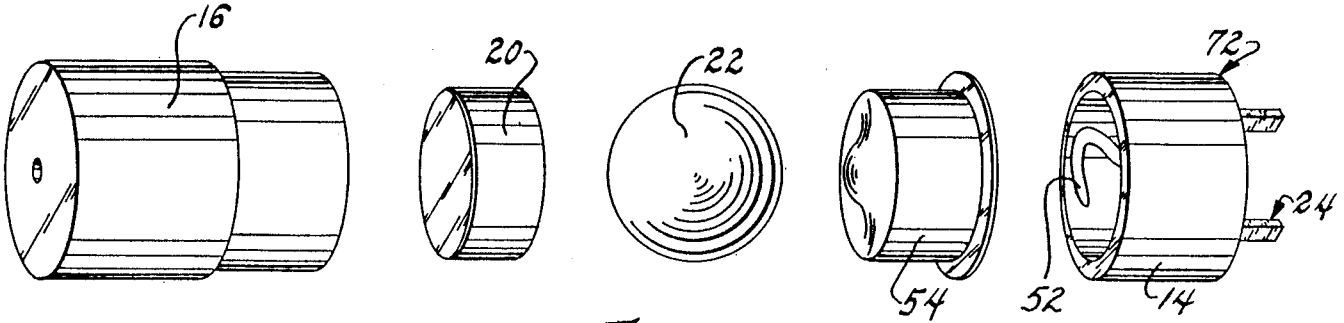
FIG. 3 is an exploded perspective view illustrating the assembly of the sensor of FIG. 2.

The contact assembly 24 consists of a pair of leads 46, 48 formed in blade-like fashion, as may best be seen in FIG. 3. The leads 46, 48 are formed to a establish a switching contact between a source of electrical power such as the battery of the vehicle (not shown) and the known inflatable occupant restraint device 12. One lead 48 includes a bent-over contact tab 50 and the other lead 46 is coiled to form a resilient contact in spiral, spring-like fashion, as is best illustrated in FIG. 2. The inner terminus of the coiled lead 46 is a contact dish 52 which is positioned in registration with the contact 50 of lead 48. In the assembled state of the lead 46, the contact 52 abuts a portion of the damping assembly 26 to urge it to the position establishing contact with the sensing mass 22 as shown in FIG. 2.

The damping assembly 26 consists of a rolling diaphragm 54 formed of rubber or similar material preferably clampingly engaged between the inner surface 56 of the wall 42 of cover member 18 and the annular end surface 58 of the housing 16. It is sized to be conformable to the inner diameter 30 of the housing 16 and has at its inner end an aperture 60 covered by a reinforcing plate 62 through which a plurality of orifices 64 are formed. As can be seen in FIG. 1, the reinforcing plate 62 is crowned as indicated at 66 to provide for tangential contact with the acceleration sensing mass 22. Fixed connection between the reinforcing plate 62 and the rolling diaphragm 54 may be effected by suitable bonding techniques.

Assembled as illustrated in FIG. 2, the rolling diaphragm 54 with its reinforcing plate 62 defines a pair of chambers 68, 70 between which communication is effected by the orifices 64. The chambers 68, 70 are preferably filled with a dry inert gas, such as nitrogen or argon, at assembly. This technique both improves the environmental conditions for resisting corrosion in components such as the contacts 46, 48 and the ball 22 and magnet 20, and facilitates the permanent adhesive bonding or fusing, if that fastening technique is chosen, of the housing 16 to the cover 18 and the magnet 20.

Operation of the sensor 14 of the present invention is similar to that of the spring biased magnetically biased sensors the prior art in that the sensing mass 22 is magnetically attracted to the permanent magnet 20 for all acceleration levels sensed below a predetermined threshhold and in the movement of the acceleration sensing mass or ball 22 in response to accelerations sensed about that threshhold. When such acceleration occurs, the ball 22 moves along the bore 30 rightwardly as viewed in FIG. 2 against the reinforcing plate 62 rolling back the diaphragm 54 until the contact 52 of level 46 abuts the contact tab 50 of lead 48 to activate the inflatable restraint device 12. Rather than controlling the rate of the motion of the ball 22 by fluid damping the ball itself through peripheral clearance control, the damping is effected by appropriate sizing of the orifices 64. The clearance indicated at 31 between the bore 30 and the ball 22 can be maintained relatively large and the sizing of the orifices 64 can be controlled within the tolerances of simple drilling operations by choosing a plurality or orifices to define a flow area or equivalent orifice area appropriate to achieve the desired damping of the ball 22. The use of the simple drilled passages defining the orifices 64 provides a simpler developmental tool for the designer of a sensor for a particular vehicle application. This is of particular value since the sharpness in circularity of the drilled passages of orifices 64 provide a more readily repeatable definition of flow area for damping than controlling peripheral clearance around the ball 22 within the bore 30.

Figure 5:
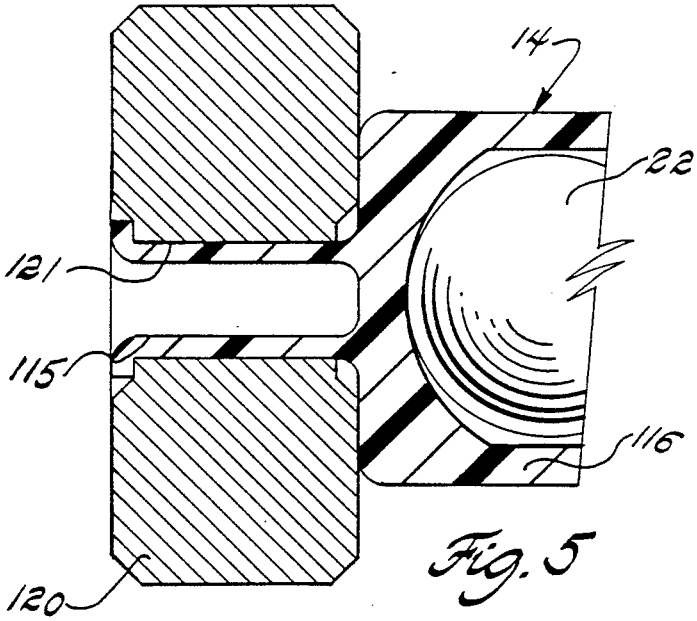
FIG. 5 is a partial cross-sectional view of another alternative embodiment.

The sensor 14 of the present invention provides a design that is readily adaptable to automatic assembly since it is assembled in cartridge-like fashion, as may best be seen in FIG. 3. Of the components heretofore described, the contact assembly 24 may be formed as a unitary subassembly with the cover 14 to define a cover and contacts subassembly 72. This facilitates the direct axial assembly of the sensor 14, as shown in explosion view in FIG. 3. The biasing magnet 20, cylindrically formed, is inserted into the housing 16 within which a bead of adhesive 44 has been laid as shown in FIG. 2. The sensing ball 22 is then inserted on top of the magnet 20 and the damping assembly 26 is inserted within the housing 16 and is trapped by the cover 18 which engages a bead of adhesive applied to the housing 16, as likewise illustrated in FIG. 2 at 45. Similar convenient assembly can be accomplished in modified sensor 114 shown in FIG. 5 wherein a permanent magnet 120 having a central bore 121 is carried on a stem 115 projecting from a housing 116 to form a subassembly.

Figure 4:
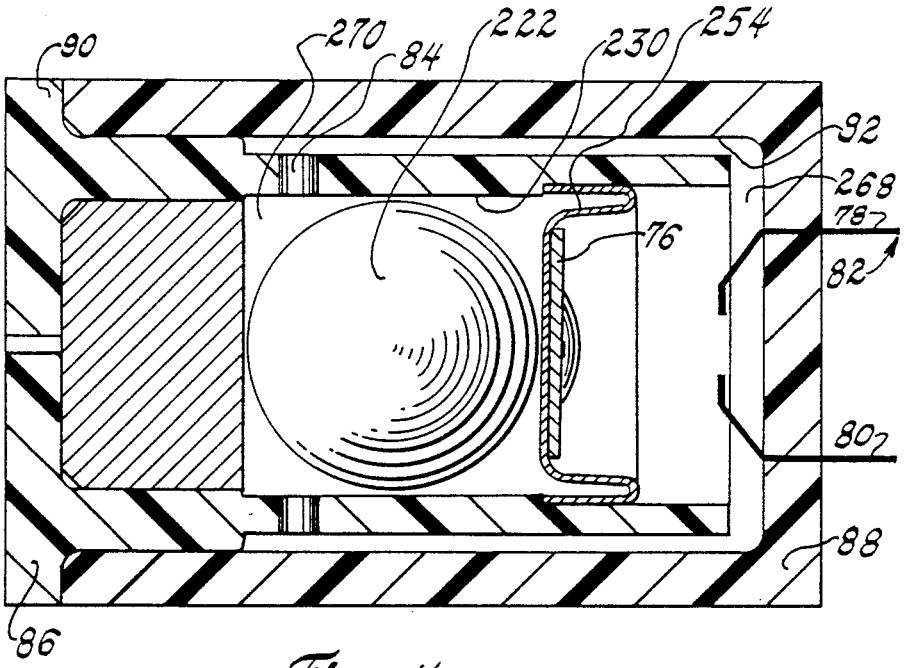
FIG. 4 is a diagrammatic cross-sectional view of an alternate embodiment of the sensor of the present invention.

In the alternative embodiment of FIG. 4, where like numbers preceded by the numeral "2" are used for like parts, the rolling diaphragm 254 may be self-biased to engage the ball 222 without interposition of a reinforcing plate 262, which in this embodiment is carried bonded to the side of the diaphragm 254 remote from the ball 222. It will be appreciated, however, that a light spring load, such as is imposed by the contact assembly 24 in the FIG. 2 embodiment may likewise be used. In this alternative embodiment, however, contact between leads 78, 80 of an alternative contact assembly 82 are electrically interconnected by the reinforcing plate 76 upon sensation of an appropriate level of acceleration. The other significant differences between the preferred embodiment of FIG. 2 and the preferred embodiment of FIG. 4 lie in the provision of a plurality of orifices 84 formed through the housing 86 to provide metered communication between chambers 268, 270 defined on either side of the diaphragm 254. The housing 86 is likewise modified to effect attachment with a modified cover 80 only at a base annular flange 90. While the diaphragm 254 is fixedly secured by bonding or adhesive application to an internal bore 92 formed in the housing 86 outwardly spaced from the bore 230 which receives the sensing ball 222.

While only certain embodiments of the present invention have been described, others may be possible without departing from the scope of the appended claims.

I claim:

1. An acceleration sensor for transmitting an electrical signal to effect operation of an inflatable occupant restraint system for an automobile upon the occurrence of an acceleration pulse of a predetermined magnitude and duration, the sensor comprising:

an elongated housing having one open end;

a sensing mass slidingly received in the housing through the open end;

a cover sealingly engaged with the housing and closing the open end thereof;

a contact assembly carried with the cover and having portions movable between an inactive position and an active position transmitting the electrical signal; and a movable damping assembly fixedly secured to the housing defining a first chamber surrounding the sensing mass and a second chamber surrounding the contact assembly and comprising a plurality of orifices providing fluid communication between the chambers, the sensing mass being movable against the damping assembly to move the contact assembly portions to the active position.

2. An acceleration sensor as defined in claim 1 wherein the peripheral clearance between the sensing mass and the housing defines an equivalent orifice area greater than the flow area of the plurality of orifices of the damping assembly.

3. An acceleration sensor as defined in claim 1 and further comprising means biasing the sensing mass towards the closed end of the housing to prevent certain movement of the sensing mass absent the occurrence of an acceleration pulse of predetermined magnitude and duration.

4. An acceleration sensor as defined in claim 2 and further comprising means biasing the sensing mass towards the closed end of the housing to prevent certain movement of the sensing mass absent the occurrence of an acceleration pulse of predetermined magnitude and duration.

5. An acceleration sensor as defined in claim 3 wherein the biasing means is a permanent magnet.

6. An acceleration sensor as defined in claim 4 wherein the biasing means is a permanent magnet.

7. An acceleration sensor as defined in claim 1 wherein the sensing mass comprises a ball.

8. An acceleration sensor as defined in claim 4 wherein the sensing mass comprises a ball.

9. An acceleration sensor as defined in claim 6 wherein the sensing mass comprises a ball formed of magnetically permeable material.

10. An acceleration sensor as defined in claim 1 wherein the contact assembly includes biasing means normally urging the movable damping assembly into contact with the sensing mass.

11. An acceleration sensor as defined in claim 1 wherein the movable damping assembly comprises a flexible rolling diaphragm having an outer diametral portion clampingly secured between the cover and the housing and having a central aperture covered by a rigid reinforcing plate through which the plurality of orifices are formed.

12. An acceleration sensor as defined in claim 1 wherein the movable damping assembly comprises:

an imperforate flexible rolling diaphragm secured to the housing and the plurality of orifices are formed through the housing.

13. An acceleration sensor as defined in claim 9 wherein the movable damping assembly comprises a flexible rolling diaphragm having an outer diametral portion clampingly secured between the cover and the housing and having a central aperture covered by a rigid reinforcing plate through which the plurality of orifices are formed.

14. An acceleration sensor as defined in claim 9 wherein the movable damping assembly comprises:

an imperforate flexible rolling diaphragm secured to the housing and the plurality of orifices are formed through the housing.

15. An acceleration sensor as defined in claim 1 wherein the chambers are filled with a dry, inert gas.

16. An acceleration sensor as defined in claim 13 wherein the chambers are filled with a dry, inert gas.

17. An acceleration sensor as defined in claim 14 wherein the chambers are filled with a dry, inert gas.

18. An acceleration sensor for transmitting an electrical signal to effect operation of an inflatable occupant restraint system for an automobile upon the occurrence of an acceleration pulse of a predetermined magnitude and duration, the sensor comprising:

a generally cylindrical plastic housing having a stepped bore formed therein and having an open end and a closed end;

biasing means formed as a generally cylindrical permanent magnet received and adhesively secured in the housing stepped bore adjacent the closed end thereof, a sensing mass formed as a magnetically permeable ball received in the stepped bore adjacent the permanent magnet, a cover sealingly engaging and closing the open end of the housing and having a closed end carrying a contact assembly having movable portions extending toward the sensing mass; and a damping assembly comprising a flexible rolling diaphragm having an outer diametral portion clampingly secured between the cover and the housing and having a central aperture covered by a rigid reinforcing plate through which a plurality of orifices are formed thereby defining a first chamber surrounding the sensing mass and a second chamber surrounding the contact assembly.

19. An acceleration sensor as defined in claim 18 wherein the peripheral clearance between the sensing mass ball and the housing bore defines an equivalent orifice area greater than the plurality of orifices of the damping assembly.

20. An acceleration sensor as defined in claim 19 wherein the contact assembly includes biasing means normally urging the rolling diaphragm against the ball.

21. An acceleration sensor as defined in claim 18 wherein the chambers are filled with a dry, inert gas.

22. An acceleration sensor for transmitting an electrical signal to effect operation of an inflatable occupant restraint system for an automobile upon the occurrence of an acceleration pulse of a predetermined magnitude and duration, the sensor comprising:

a generally cylindrical plastic housing having a stepped bore formed therein and having an open end and a closed end;

biasing means formed as a generally cylindrical permanent magnet received and adhesively secured in the housing stepped bore adjacent the closed end thereof, a sensing mass formed as a magnetically permeable ball received in the stepped bore adjacent the permanent magnet, a cover sealingly engaging and closing the open end of the housing and having a closed end carrying a contact assembly having movable portions extending toward the sensing mass; and a damping assembly comprising an imperforate flexible rolling diaphragm secured to the housing and having a plurality of orifices formed through the housing, thereby defining a first chamber surrounding the sensing mass and a second chamber surrounding the contact assembly.

23. An acceleration sensor as defined in claim 22 wherein the peripheral clearance between the sensing mass and the housing defines an equivalent orifice area greater than the flow area of the plurality of orifices of the damping assembly.

24. An acceleration sensor as defined in claim 23 wherein the chambers are filled with a dry, inert gas.

* * * * *